US007950088B2

(12) United States Patent
Dalton et al.

(10) Patent No.: US 7,950,088 B2
(45) Date of Patent: May 31, 2011

(54) METHOD OF INDICATING OPERATIONAL INFORMATION FOR A DISPENSING SYSTEM HAVING BOTH SINGLE USE AND BULK DISPENSING

(75) Inventors: Michael T. Dalton, Saint Joseph, MI (US); Karl D. McAllister, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 373 days.

(21) Appl. No.: 12/166,220

(22) Filed: Jul. 1, 2008

(65) Prior Publication Data

US 2010/0000025 A1 Jan. 7, 2010

(51) Int. Cl.
*D06F 39/08* (2006.01)

(52) U.S. Cl. ..... 8/158; 68/17 R; 68/207

(58) Field of Classification Search ..... 68/17 R, 68/207

See application file for complete search history.

(56) References Cited

U.S. PATENT DOCUMENTS

| | | | | |
|---|---|---|---|---|
| 2,816,427 | A | 12/1957 | Vela | |
| 3,120,329 | A | 2/1964 | Noakes | |
| 4,009,598 | A | 3/1977 | Bernard et al. | |
| 4,162,028 | A * | 7/1979 | Reichenberger | 222/129.4 |
| 4,580,721 | A * | 4/1986 | Coffee et al. | 239/3 |
| 4,763,493 | A | 8/1988 | Nishite et al. | |
| 4,862,711 | A * | 9/1989 | Ikeda et al. | 68/12.18 |
| 4,875,607 | A | 10/1989 | Torita et al. | |
| 5,063,757 | A | 11/1991 | Ikeda et al. | |
| 5,088,621 | A * | 2/1992 | Thompson et al. | 222/1 |
| 5,134,867 | A | 8/1992 | Kiuchi et al. | |
| 5,195,338 | A * | 3/1993 | Russo | 68/12.18 |
| 5,207,080 | A | 5/1993 | Reinhard | |
| 5,392,827 | A * | 2/1995 | Yasso et al. | 141/192 |
| 5,417,233 | A | 5/1995 | Thomas et al. | |
| 5,636,763 | A * | 6/1997 | Furness | 222/54 |
| 5,836,482 | A * | 11/1998 | Ophardt et al. | 222/325 |
| 5,870,906 | A * | 2/1999 | Denisar | 68/17 R |
| 5,913,454 | A * | 6/1999 | McHale | 222/2 |
| 6,349,440 | B1 | 2/2002 | Amberg et al. | |
| 6,401,499 | B1 * | 6/2002 | Clark et al. | 68/17 R |
| 7,036,175 | B2 * | 5/2006 | Sears et al. | 8/158 |
| 7,177,712 | B2 * | 2/2007 | Blair et al. | 700/83 |
| 7,464,718 | B2 * | 12/2008 | McIntyre et al. | 134/94.1 |
| 7,658,088 | B2 * | 2/2010 | Walker et al. | 68/17 R |
| 7,725,970 | B2 * | 6/2010 | Tuttle et al. | 8/158 |
| 2001/0049846 | A1 | 12/2001 | Guzzi et al. | |
| 2003/0010791 | A1 * | 1/2003 | Gentiluomo et al. | 221/92 |
| 2003/0233168 | A1 * | 12/2003 | Perin et al. | 700/236 |
| 2004/0010859 | A1 | 1/2004 | Kim et al. | |

(Continued)

FOREIGN PATENT DOCUMENTS

DE 3403622 A1 8/1985

(Continued)

OTHER PUBLICATIONS

European Patent Office Jan. 1990.*

*Primary Examiner* — Frankie L Stinson
(74) *Attorney, Agent, or Firm* — McGarry Bair P.C.; Clifton G. Green

(57) ABSTRACT

A user interface of a cleaning appliance and the method of operation for a cleaning appliance having a single dose treating chemistry dispenser and a bulk dispensing system.

23 Claims, 5 Drawing Sheets

U.S. PATENT DOCUMENTS

| | | | | |
|---|---|---|---|---|
| 2006/0107705 | A1 | 5/2006 | Hsu et al. | |
| 2006/0117811 | A1 * | 6/2006 | Kinnetz | 68/17 R |
| 2006/0272359 | A1 | 12/2006 | Kang | |
| 2006/0272360 | A1 | 12/2006 | Hsu et al. | |
| 2007/0084253 | A1 | 4/2007 | Ehrlich et al. | |
| 2007/0261177 | A1 | 11/2007 | Risen et al. | |
| 2010/0040213 | A1 * | 2/2010 | Park et al. | 379/106.01 |

FOREIGN PATENT DOCUMENTS

| | | | |
|---|---|---|---|
| DE | 38 33 961 | * | 4/1990 |
| DE | 3908438 | A1 | 9/1990 |
| DE | 4014776 | A1 | 11/1991 |
| DE | 19902974 | A1 | 10/1999 |
| DE | 10144667 | A1 | 3/2003 |
| EP | 1063340 | A1 | 12/2000 |
| EP | 1637060 | A2 | 3/2006 |
| EP | 1808520 | A1 | 7/2007 |
| EP | 1842953 | A2 | 10/2007 |
| EP | 1731654 | | 12/2007 |
| GB | 2 214 524 | * | 9/1989 |
| GB | 2 311 767 | * | 10/1997 |
| GB | 2386130 | A | 9/2003 |
| GB | 2417492 | A | 3/2006 |
| JP | 3191994 | A | 8/1991 |
| WO | 0220893 | A1 | 3/2002 |
| WO | 02058528 | A1 | 8/2002 |
| WO | 2006037354 | A1 | 4/2006 |
| WO | 2006042631 | A1 | 4/2006 |
| WO | 2006061041 | A1 | 6/2006 |
| WO | 2006098571 | A1 | 9/2006 |
| WO | 2007056097 | A2 | 5/2007 |
| WO | 2008053183 | A1 | 5/2008 |
| WO | 2008155264 | A1 | 12/2008 |

* cited by examiner

METHOD OF INDICATING OPERATIONAL INFORMATION FOR A DISPENSING SYSTEM HAVING BOTH SINGLE USE AND BULK DISPENSING

BACKGROUND OF THE INVENTION

Cleaning appliances, such as dishwashers or clothes washers, are often provided with a dispensing system for automatically dispensing one or more treating chemistries during a cleaning cycle. One common type of dispenser is the manual or single use dispenser, which may be filled with a dose of treating chemistry sufficient for a single cleaning cycle. The single use dispensers typically dispense the entire quantity of the chemistry contained within them (enough for one cleaning cycle) during the cycle. Another type of dispenser is a bulk dispenser, which contains an amount of treating chemistry sufficient for multiple cleaning cycles. Some cleaning appliances have both a single use dispenser and a bulk dispenser.

SUMMARY OF THE INVENTION

A method of determining which one of a single use dispensing system and a bulk dispensing system will dispense treating chemistry during the cycle of operation.

DESCRIPTION OF THE EMBODIMENTS OF THE INVENTION

Figure 1:
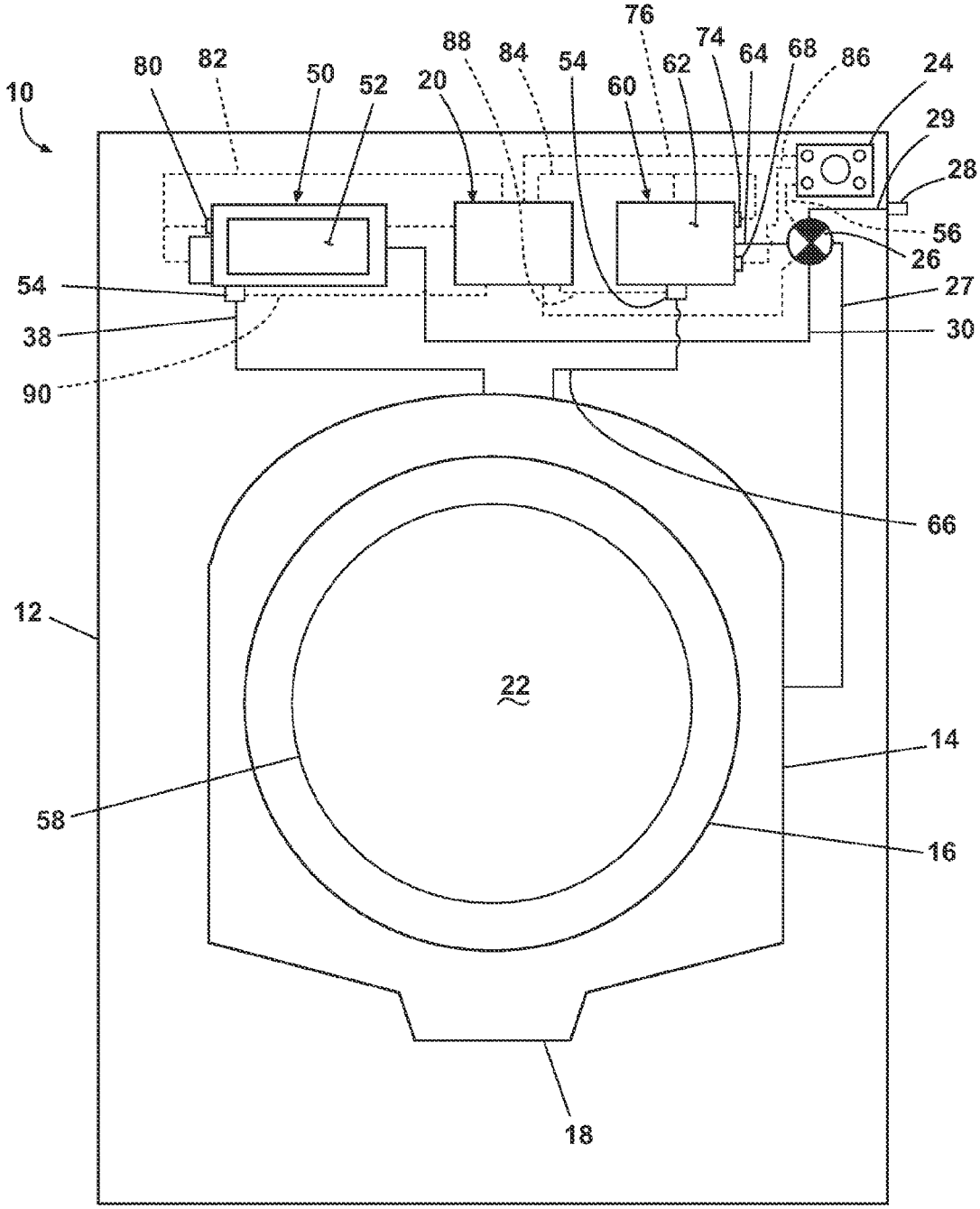
FIG. 1 is a schematic view of an automatic clothes washing machine having a dispensing system and user interface according to one embodiment of the invention.

FIG. 1 illustrates a household cleaning appliance in which one embodiment of the method of the invention is implemented. The cleaning appliance is shown in the environment of a horizontal axis automatic clothes washing machine 10. Although much of the remainder of this application will focus on the embodiment of an automatic clothes washing machine, the invention may have utility in other environments, including other cleaning appliances, such as dryers and dishwashers, for example. The automatic clothes washing machine 10 shares many features of a conventional automated clothes washer, which will not be described in detail herein except as necessary for an understanding of the invention.

Further, washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element, e.g., an impeller or agitator, typically moves within a drum to impart mechanical energy directly to the clothes or indirectly through wash liquid in the drum. In horizontal axis machines mechanical energy is typically imparted to the clothes by the tumbling action formed by the repeated lifting and dropping of the clothes, which is typically implemented by the rotating drum, although the inclusion of a fabric moving element is also possible.

While technology and methods are not always interchangeable between vertical and horizontal axis machines, the invention disclosed herein may be suitable for use in both horizontal axis and vertical axis automatic clothes washing machines. The invention will be illustrated and described, however, in the context of a horizontal axis washing machine.

The automatic clothes washing machine 10 may include a cabinet 12 enclosing components typically found in a conventional washing machine, such as motors, pumps, fluid lines, controls, sensors, transducers, and the like. A door 58 may be mounted to the cabinet to selectively close an access opening to the interior of a tub 14 that defines a wash chamber 22 in which fabric articles, collectively forming a load of laundry, are treated. Both the tub 14 and a drum 16 are suspended in the interior of the cabinet 12. The tub 14 may be associated with a sump 18 for temporarily holding a liquid used during a cleaning cycle. The liquid may be only water or may be a mixture of water and a treating chemistry, such as a detergent. Other treating chemistries, such as bleach or softener, may also be in the mixture.

The cabinet 12 may include a user interface 20 that has operational controls such as dials, lights, switches, and displays enabling a user to input commands to a controller 24 and receive information about a specific cleaning cycle. The user interface 20 may be electrically coupled with the controller 24 through user interface leads 76. When the controller 24 is a microprocessor controller, the various cleaning cycles capable of being implemented by the controller 24 may be stored in internal memory of the controller 24 or memory associated with the controller 24. These cycles may be any desired cycle, including all currently known cycles. The term cleaning cycle may be used to mean one operational cycle of the automatic clothes washing machine 10 that cleans a laundry load having one or more articles, and it may include one or more wash portions, rinse portions, and spin portions, for example. The term cleaning cycle is not limited to a wash cycle in the traditional sense where laundry is washed in a water and detergent solution. The term cleaning cycle may include applying a treating chemistry to the laundry.

A single use dispensing system 50 and a multi-use or bulk dispensing system 60 may also be located in the cabinet 12. Each of these dispensing systems may dispense treating chemistry during a cleaning cycle. The treating chemistry may be any type of aid for treating fabric, and examples may include, but are not limited to washing aids, such as detergents and oxidizers, including bleaches, and additives, such as fabric softeners, sanitizers, de-wrinklers, whiteners/brighteners, and chemicals for imparting desired properties to the fabric, including stain resistance, fragrance (e.g., perfumes), insect repellency, and UV protection. A water control system is provided to supply the single use and bulk dispensing systems 50, 60 with water and to supply the tub 14 with water.

As used herein, the term single dose of treating chemistry, and variations thereof, refers to an amount of treating chemistry sufficient for one cleaning cycle of the automatic clothes washing machine 10 and the term multiple doses of treating chemistry, and variations thereof, refers to an amount of treating chemistry sufficient for multiple cleaning cycles of the automatic clothes washing machine.

Looking at the components of the washing machine in greater detail, the controller 24 may be operably coupled to both the single use dispensing system 50 and the bulk dispensing system 60. The controller 24 may enable operation of a single use dispensing mode by selecting the single use dispensing system 50, or a bulk dispensing mode by selecting the bulk dispensing system 60. In this way, the controller 24 may control the selective dispensing of treating chemistry to the wash chamber 22 during the cleaning cycle from either of the dispensing systems 50, 60.

The water control system may also include a conduit 29 fluidly coupling a control valve 26 to a household water supply 28. The valve 26 may be fluidly coupled to tub 14, single use dispensing system 50, and bulk dispensing system 60 by dispensing lines 27, 30, and 64, respectively. In this way, the valve 26 may be used to control the selective distribution of the household water supply to the water-using components of the washing machine 10.

Dispensing lines 38, 66 may fluidly couple the manual dispensing system 50 and bulk dispensing system 60, respectively, with the tub 14. Thus, fresh water may be delivered from the water supply 28 through the conduit 29, valve 26 and selectively to dispensing lines 30, 64 into the manual dispensing system 50 or bulk dispensing system 60, for flushing treating chemistry there from and to the tub 14 through the dispensing lines 38, 66, respectively. The valve 26 may be electrically coupled with the controller 24 through a valve control lead 56. The controller 24 may control the operation of the valve 26 in response to instructions received from the user interface 20 as a result of selections made by the user, such as cleaning cycle, water temperature, spin speed, extra rinse, and the like.

The single use dispensing system 50 typically includes at least one dispensing chamber 52 that stores a single dose of treating chemistry that the dispensing system 50 dispenses to the wash chamber 22 as part of the execution of the cleaning cycle. Because the user has the option of manually filling the single use dispensing chamber 52, the single use dispensing system 50 may be provided with a sensor 80 operably coupled to the controller 24 to communicate to the controller 24 information that may be indicative of or that may be used to determine whether treating chemistry has been provided in the dispensing chamber 52. This information may then be used, alone or in combination with other information, by the controller 24 to determine whether the treating chemistry should be automatically supplied by the single use dispensing system 50 or the bulk dispensing system 60.

The bulk dispensing system 60 may include at least one bulk dispensing chamber 62 that is sized to store multiple doses of treating chemistry that may be selectively dispensed into the tub 16 or the wash chamber 22 as part of the execution of the cleaning cycle. The bulk dispensing chamber 62 may further be provided with one or more sensors 68 that may be used to provide about the status of the bulk dispensing system 60, such as: type of treating chemistry, amount of treating chemistry, and amount dosed, for example. The sensor 68 may be in communication with the controller 24 via a lead 86. The controller may use the information to control a wash cycle or to display the information on the user interface 20. For example, if the sensor 68 is a fill sensor used to determine the amount of treating chemistry in the chamber 62, the controller may display this information on the user interface 20 for viewing by the consumer. The fill sensor 68 may use a float, a light or other visual indication, or an alarm or other audio indication to indicate the fill status of the bulk dispensing chamber 62. The fill sensor 68 may be any combination of visible or audible indication.

The bulk dispensing chamber 62 may include a sensor 74 indicating the presence of treating chemistry in the bulk dispensing chamber 62. The sensor 74 may be any suitable type of sensor, such as a pressure sensor or proximity sensor for example, for sensing the presence of treating chemistry in the dispensing chamber 62. Regardless of the type, the sensor 74 may send a signal to the controller 24 through lead 84 to indicate the presence of the treating chemistry in the dispensing chamber 62. The foregoing description may be of an exemplary sensor location; other locations may be utilized for the sensor 74. The sensors 68 and 74 may also be used with the single use dispensing system 50 to provide the same or similar information to the controller 24.

The bulk dispensing system 60 may further include a treating chemistry meter 54 to dispense a predetermined amount of treating chemistry each cleaning cycle. The predetermined amount may vary from cycle-to-cycle, even for the same cycle, and will typically be set by the controller 24. The treating chemistry meter 54 may be a pump with a known displacement or flow rate, a mechanical flow meter, a magnetic flow meter, or any other meter suitable for measuring liquid flow, all well known in the cleaning appliance art. The treating chemistry meter 54 may send a signal to the controller 24 through leads 88, 90, and 76 that is indicative of or used to determine the amount of treating chemistry that has been dispensed to the wash chamber 22. If desirable, the treating chemistry meter 54 may be used with the single use dispenser.

Figure 2:
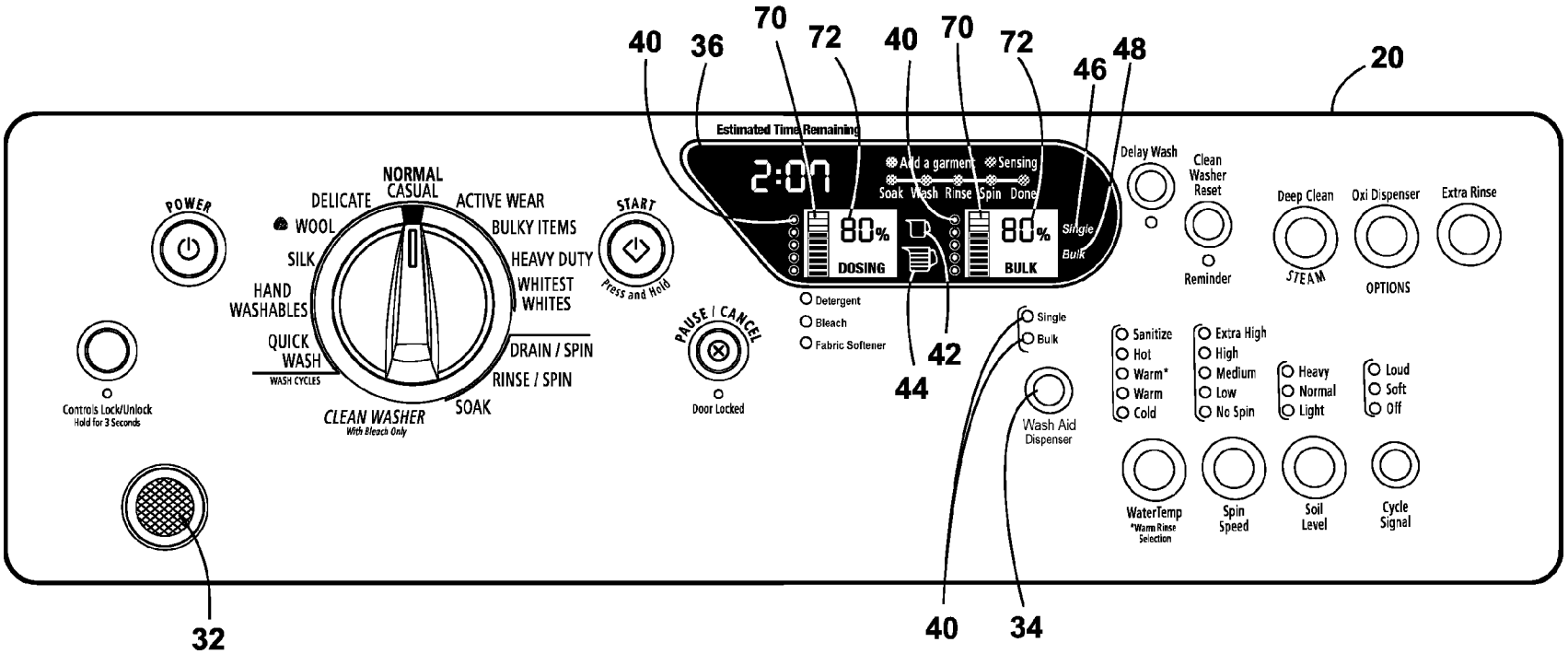
FIG. 2 is a detail view of the user interface of the cleaning appliance of FIG. 1 according to one embodiment of the invention.

Referring to FIG. 2, the user interface 20 according to one implementation of the invention is shown. The user interface 20 may have a combination of operational controls such as dials, lights, switches, buttons, and displays enabling a user to input commands to the controller 24 and to receive information about a specific cleaning cycle. The user interface, as described here, is not limited to a visual display, but may also include communication to and from the user such as an audible indicator, a microphone, or a camera for example.

The user interface 20 may include the user inputted selection of fabric type, water temperature, spin speed, and wash delay, soil level, and cycle signal. The user interface 20 of the contemplated invention may further include an indication of which of the manual dispensing system 50 and the bulk dispensing system 60 will dispense treating chemistry during the operation of the cleaning cycle. This indication may be displayed as a visual indicator, an audible indicator, or both.

In an exemplary implementation, when the presence of treating chemistry is detected in the single use dispensing chamber 52 at the initiation of a cleaning cycle, i.e. when the user has manually supplied treating chemistry to the single use dispensing chamber 52, it may be presumed that the user wishes to dispense from the single use dispensing system 50 instead of the bulk dispensing system 60. The controller 24 may use this logic and control the operation of the single use dispensing system 50 and the bulk treating chemistry dispensing system 60 to dispense the treating chemistry from the single use dispensing system 50. This logic may be applied by the controller 24 even when both the single use dispensing chamber 52 and the bulk dispensing chamber 62 have treating chemistry. When the presence of treating chemistry is not detected in the single use dispensing chamber 52, the controller 24 may effect the automatic supply of treating chemistry from the bulk dispensing system 60 to the wash chamber 22, assuming the bulk dispensing system 60 has a sufficient amount of treating chemistry as determined by the controller 24 based on the selected cycle and options.

Figure 2A:
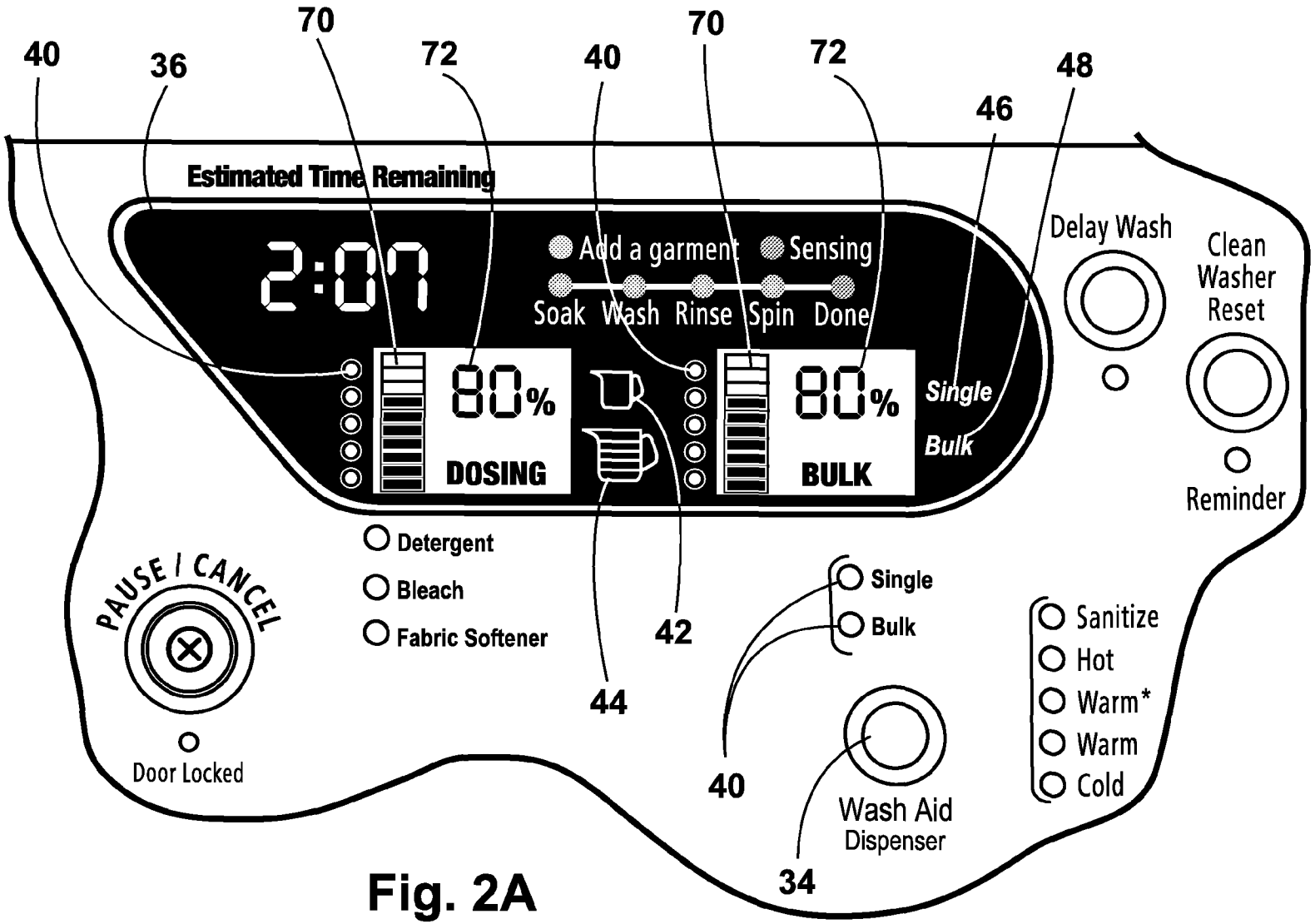
FIG. 2A is a detail view of an enlarged portion of the user interface illustrated in FIG. 2.

Referring to FIG. 2A, an indication may be displayed on the user interface 20 of which one of the single use dispensing system 50 and the bulk dispensing system 60 has been determined to provide treating chemistry to the wash chamber 22. The determination may be displayed via a visual indicator such as a single use icon 42 or a bulk dispensing icon 44; an alpha-numeric character 72 such as the word "single" 46 or "bulk" 48 shown on an LCD screen 36, or similar; a light 40, such as an LED or any other suitable source of illumination, that may be illuminated indicating either single or bulk. Display of the determination may also include an audible indication, such as a unique sequence or tone of chimes or a recorded voice speaking cycle options selected, via a speaker 32 located on the user interface 20, or any other suitable location.

A selection button 34 may also be provided on the user interface 20 allowing the user to override the controller's 24 automatic dispensing determination, as described above, for a single cleaning cycle. In this method, the selection of which the single use dispensing system 50 or the bulk dispensing system 60 will dispense may be inputted by the user through the button 34. The button 34 may be any suitable type of selection means, for example a toggle button to toggle the user's input between single use and bulk use. The user's overriding selection may be displayed on the user interface 20 as described above.

The user interface 20 may also display the amount of treating chemistry contained in the bulk dispensing chamber 62. This information may be provided via the controller 24, through lead 86, as determined by the fill sensor 68. The amount may be displayed on the user interface 20 as a fill percentage as related to a full bulk dispensing chamber 62, by means of an alpha-numeric character 72 reading on an LCD screen 36, or similar; a bar 70 reading to be proportionally illuminated; or a stack of lights 40 to be proportionally illuminated.

Additionally, in some embodiments of the invention, the type of treating chemistry present in the bulk dispensing chamber 62 can be automatically recognized. Examples of the methods for automatically recognizing the type of treating chemistry present include, but are not limited to, user input, utilizing a keyed treating chemistry cartridge or cartridge with a RFID (radio-frequency identification) tag or chip, or sensors, such as refractive incidence sensors, to sense the type of chemistry. In the case that automatic recognition of the chemistry type is not provided in the washing machine 10, a selection button for inputting information about the treating chemistry can be provided. While not illustrated, this input may be located and displayed on the user interface 20 in the same manner as the methods described above. Specific examples of manual input for the bulk dispensing system 60 are concentration level, indicating 1×, 2×, or 3× treating chemistry concentration, or total treating chemistry volume to be dispensed, in either volumetric measurements or high, medium, or low increments.

Further, the user interface 20 may also display the status of the dosing operation from one of the single use dispensing system 50 or the bulk dispensing system 60. This information is provided to the user interface 20 for display via the leads 88, 90, as monitored by the treating chemistry meters 54. The amount dosed may be displayed on the user interface 20 as a percentage of the total dispensing amount for the wash cycle, by means of an alpha-numeric character 72 reading on a LCD screen 36, or similar; a bar 70 reading to be proportionally illuminated; or a stack of lights 40 to be proportionally illuminated. The user interface 20 may also indicate when the dispensing is occurring, and what proportion of the total has been dispensed, throughout the actual dispensing. Also, dosing of the treating chemistry may occur in multiple chemistry additions per cycle of operation and a proportional and cumulative amount with respect to the total would be indicated on the user interface 20. As additional dosing occurs, the increasing proportion would be displayed on the user interface 20 until dosing is complete. Completion of the dosing operation may be indicated on the user interface 20 by means such as a "100%" alpha-numeric character 72 reading on the LCD screen 36, or similar; a fully illuminated bar 70 reading; or a fully illuminated stack of lights 40. Optionally, an alpha-numeric indication, such as the word "complete", may be displayed in the dosing information area on the user interface 20.

The single use dispensing system 50 may be capable of receiving and containing multiple types of treating chemistry in multiple chambers within the single use dispensing chamber 52. Examples of the different types of treating chemistry that may be dispensed include, but are not limited to, detergent, bleach, in-wash stain removers (such as Oxi-Clean or Vanish), color safe bleaches, oxidizing agents, and fabric softener. The user interface 20 may display the currently dispensing treating chemistry type by, for example, illuminating the light 40 indicating the treating chemistry type. Alternatively, the alpha-numeric character 72 of each wash type may be displayed on the LCD screen 36, or similar.

Figure 3:
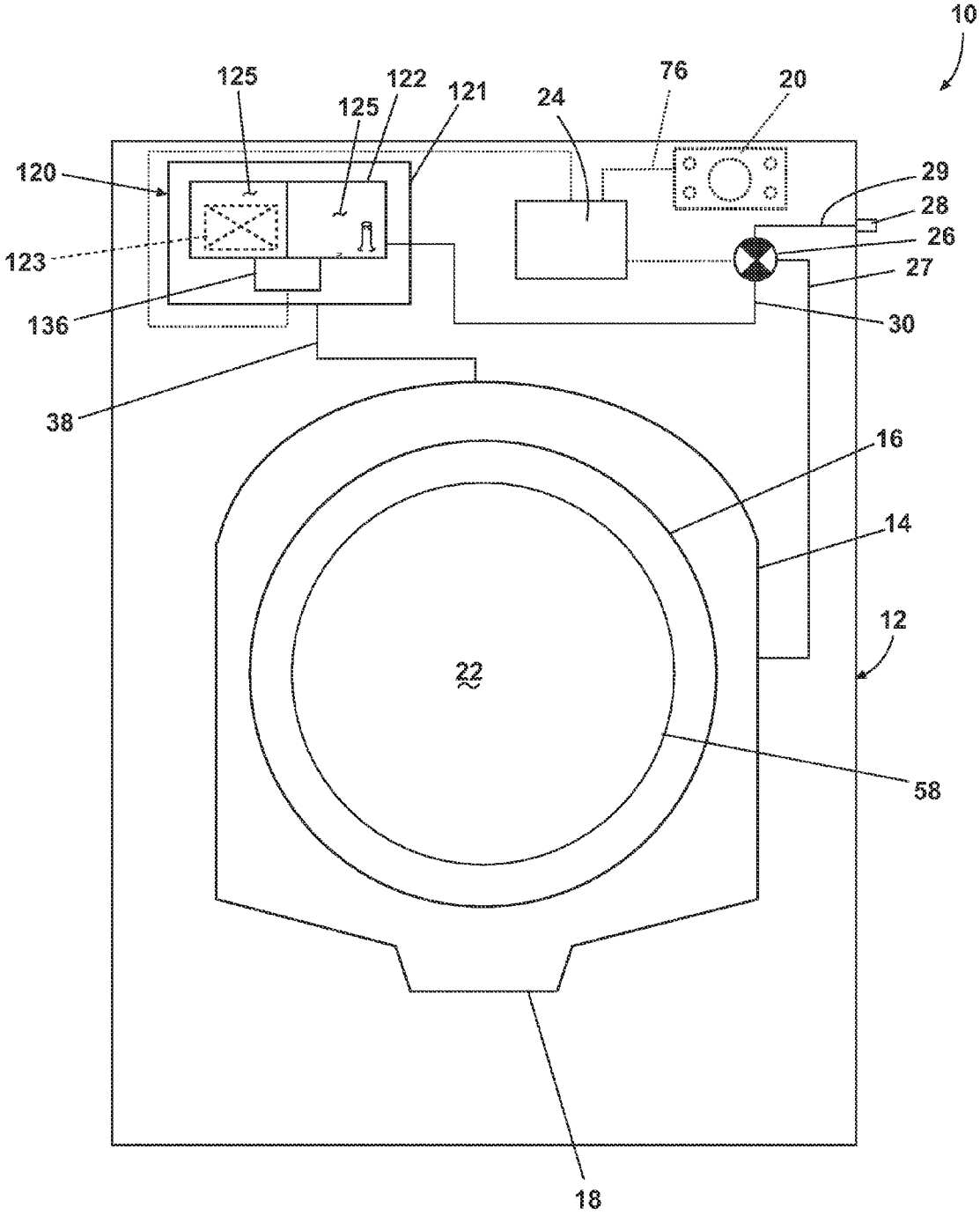
FIG. 3 is a schematic view of an automatic clothes washing machine having an exemplary dispensing system, with a bulk dispensing cartridge according to one embodiment of the invention.

Referring to FIG. 3, a specific implementation of a bulk dispensing system 120 is shown, as described in co-pending U.S. patent application Ser. No. 12/165,726, filed Jul. 1, 2008, entitled "A METHOD FOR CONVERTING A HOUSEHOLD CLEANING APPLIANCE WITH A NON-BULK DISPENSING SYSTEM TO A HOUSEHOLD CLEANING APPLIANCE WITH A BULK DISPENSING SYSTEM," which is incorporated herein by reference in its entirety. This invention describes a dispensing system 120 capable of being used as a single use dispensing system and a bulk dispensing system when a bulk dispensing cartridge 123 is inserted into the at least one dispensing cup 125 of the single use dispensing system.

Although the bulk dispenser cartridge has been illustrated or described as a rectangular box-like container, the bulk dispensing cartridge may be any type of removable container configured to store multiple doses of a treating chemistry. The container may have any shape and size that is receivable within the dispenser. The removable container may be flexible, rigid, expandable, or collapsible. The container may be made of any type of material. Some examples of suitable cartridges are, without limitation, a plastic container, a cardboard container, a coated cardboard container, and a bladder, all of which are capable of being received within the dispenser.

When received within a dispensing cup 125, the bulk dispensing cartridge 123 may fluidly couple with the at least one dispensing cup 125, or may fluidly couple with another of the dispensing cups 125, or may fluidly couple with the dispenser housing 121 to establish a dispensing flow path for the treating chemistry in the bulk dispensing cartridge. The fluid flow path may be established by forming one or more openings in the dispenser housing 121, which may be in fluid communication with the at least one dispensing cup 125. The openings may be formed by drilling or puncturing the dispenser housing 121, for example.

Figure 4:
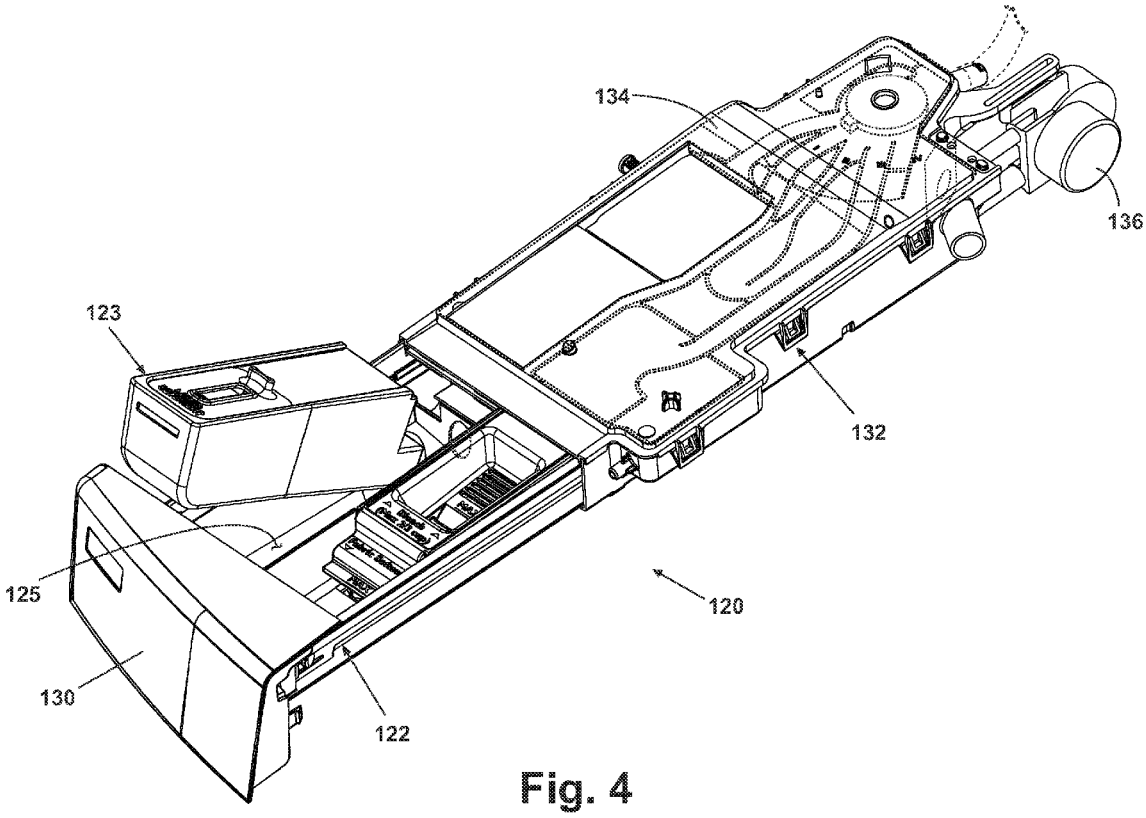
FIG. 4 is a perspective view of the bulk dispensing system illustrated schematically in FIG. 3 with the bulk cartridge partially received within a dispensing chamber, according to one embodiment of the invention.

FIG. 4 illustrates a specific example of the bulk dispensing system 120 described in FIG. 3, showing the bulk dispensing cartridge 123 partially received within the dispensing cup 125. The dispensing system shown is a specific implementation of an exemplary drawer-type, single-use dispensing system 50, which may be converted into the bulk dispensing system 120 by receiving the bulk dispensing cartridge 123 within the dispensing cup 125. The dispensing system 120 includes a dispenser drawer 122 that defines the dispensing cup 125. A handle 130 may be provided on the drawer to aid in the opening and closing of the drawer 122. A lower dispensing housing 132 underlies the drawer and captures any water flushed through the dispensing drawer as part of the dispensing process. An upper dispensing housing 134 overlies the drawer and the lower dispensing housing 132 and supplies water to the dispensing drawer 122 and/or the lower dispensing housing 132 to flush the treating chemistry into the tub 14 and/or treating chamber 22. A treating chemistry meter in the form of a dispenser pump 136 may be carried by the lower dispenser housing 132 and establishes fluid communication between the bulk dispensing cartridge 123 and the lower dispenser housing 132 when the drawer may be closed to establish a dispensing flow path from the bulk dispensing cartridge 123.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A method of operating a cleaning appliance having a dispensing system configured to operate in at least one of a single use dispensing mode and a bulk dispensing mode, which is operably coupled to a controller having a user interface through which a user may select a cycle of operation to be implemented by the controller, the method comprising:

automatically determining, by the controller, which one of the single use dispensing system and the bulk dispensing system will dispense treating chemistry during the cycle of operation; and providing an indication of the determination on the user interface.

2. The method of claim 1 wherein providing an indication comprises providing at least one of a visual indicator and an audible indicator on the user interface.

3. The method of claim 2 wherein providing an indication comprises providing both a visual indicator and an audible indicator.

4. The method of claim 2 wherein the visual indicator comprises displaying on the user interface at least one of an icon, an alpha-numeric character, and a light.

5. The method of claim 1 wherein the determining comprises receiving an input from the user through the user interface.

6. The method of claim 5 wherein the receiving an input comprises the user selecting an input on the user interface.

7. The method of claim 5 further comprising displaying on the user interface the single use dispensing mode and the bulk dispensing mode.

8. The method of claim 5 wherein the receiving an input comprises receiving an override to the determination.

9. The method of claim 1 wherein the determination comprises determining a presence of treating chemistry in the single use dispensing system.

10. The method of claim 9 wherein the determination is the single use dispensing mode when treating chemistry is present in the single use dispensing system.

11. The method of claim 9 wherein the determination is the single use dispensing mode when treating chemistry is present in both the single use dispensing system and the bulk dispensing system.

12. The method of claim 9 wherein the determination is the bulk dispensing mode when treating chemistry is not present in the single use dispensing system.

13. The method of claim 1 wherein the determination comprises automatically determining a presence of treating chemistry in the bulk dispensing system.

14. The method of claim 13 wherein the determination is the bulk dispensing mode when treating chemistry is present in the bulk dispensing system.

15. The method of claim 1 further comprising providing an indication on the user interface of an amount of treating chemistry in the bulk dispensing system.

16. The method of claim 1 further comprising providing an indication on the user interface of a dose amount of the treating chemistry from the automatically determined one of the single use dispensing system and the bulk dispensing system.

17. The method of claim 1 further comprising providing an indication on the user interface when the treating chemistry is dosed.

18. The method of claim 17 further comprising providing an indication on the user interface of a type of treating chemistry being dosed.

19. A cleaning apparatus configured to dose a treating chemistry, comprising:

a single use dispensing system configured to operate in a single dose dispensing mode;

a bulk dispensing system configured to operate in a bulk dispensing mode;

a user interface configured to provide an indication to the user; and a controller coupled with the user interface, the single use dispensing system, and the bulk dispensing system and configured to automatically determine which of the single use dispensing system and bulk dispensing system will dispense for an operating cycle and to control the user interface such that the user interface provides an indication of which of the bulk dispensing system and the single use dispensing system will be used to dispense the treating chemistry.

20. The cleaning apparatus of claim 19 wherein the single use dispensing system and the bulk dispensing system are separate systems.

21. The cleaning apparatus of claim 19 wherein the single use dispensing system and the bulk dispensing system comprise at least one common component.

22. The cleaning apparatus of claim 19 further comprising a sensor operably coupled to the controller and configured to sense a presence of treating chemistry in at least one of the single use dispensing system and the bulk dispensing system and provide a signal to the control indicative of the presence of treating chemistry and the controller uses the signal to determine which of the single use dispensing system or bulk dispensing system will be used to dispense the treating chemistry.

23. The cleaning apparatus of claim 19 wherein the user interface comprises at least one of a visual indicator and audible indicator to provide the indication.

* * * * *